US005269236A

United States Patent [19]

Okuno et al.

[11] Patent Number: 5,269,236

[45] Date of Patent: Dec. 14, 1993

[54] METHOD AND APPARATUS FOR PREVENTING THE ADHESION OF DUST IN AN INCINERATOR OR MELTING FURNACE

[75] Inventors: Satoshi Okuno; Toshihisa Gouda; Kazuo Sato; Shizuo Yasuda; Hiroki Honda; Susumu Nishikawa, all of Yokohama, Japan

[73] Assignee: Mitsubishi Jukogyo Kabushiki Kaisha, Tokyo, Japan

[21] Appl. No.: 886,248

[22] Filed: May 21, 1992

[30] Foreign Application Priority Data

Jun. 3, 1991 [JP] Japan ..... 3-131186
Jan. 16, 1992 [JP] Japan ..... 4-5658

[51] Int. Cl.[5] ..... F23L 7/00

[52] U.S. Cl. ..... 110/297; 110/215; 110/345; 110/346; 110/348; 431/170

[58] Field of Search ..... 110/297, 314, 348, 215, 110/346, 345; 431/170, 164, 165, 166, 167

[56] References Cited

U.S. PATENT DOCUMENTS 4,604,051 8/1986 Davies et al. ..... 431/170 X

FOREIGN PATENT DOCUMENTS 1091289 11/1967 United Kingdom .
1100919 1/1968 United Kingdom .
1365675 9/1974 United Kingdom .
1375431 11/1974 United Kingdom .
1441681 7/1976 United Kingdom .

*Primary Examiner*—Edward G. Favors
*Attorney, Agent, or Firm*—Wenderoth, Lind & Ponack

[57] ABSTRACT

A method of preventing dust from adhering to a wall of a combustion apparatus, such as a furnace wall or exhaust duct, is carried out by forcing gas through a porous refractory member forming the wall. Specifically, the furnace wall or exhaust duct wall to which dust might otherwise adhere is made of a porous refractory member and gas is injected through the pores of the refractory member. In an incinerator, the refractory porous member extends around the periphery of a liquid injection nozzle, so that gas fed to the inside of the incinerator through the refractory porous member prevents flower from accumulating at the periphery of the end of the nozzle and attenuates the wake of the injected liquid so as to suppress the entrainment of dust in the liquid. In a melting furnace, the refractory porous members provide the ceiling of a slag separating chamber and the entrance of an exhaust gas duct open to the upper portion of the slag separating chamber. Plate-like members form wind chambers with the porous refractory members so that cooling gas fed into the wind chambers is forced into the slag separating chamber and exhaust duct through the pores in the refractory porous members.

16 Claims, 7 Drawing Sheets

METHOD AND APPARATUS FOR PREVENTING THE ADHESION OF DUST IN AN INCINERATOR OR MELTING FURNACE

BACKGROUND OF THE INVENTION

1. Field of the Invention

The present invention relates to a method of preventing dust from adhering to a wall, such as the side wall of an incinerator or the walls of a furnace, and to an incinerator and a melting furnace which are provided with means for preventing dust from adhering to interior surfaces thereof.

2. Description of the Prior Art

A prior art water injection nozzle for cooling hot exhaust gas containing a large quantity of dust is shown in FIG. 8.

The water injection nozzle 1 extends into a gas cooling chamber 2 through a refractory wall 3. Water 4 for cooling the gas is introduced from a water inlet 5 of the water injection nozzle 1 into a pipe 5*a* extending axially in the nozzle 1. The water 4 is thus injected from the tip of the nozzle 1 into the gas cooling chamber 2. Excess water flows to a water return line via a water outlet 6 of a pipe 6*a* which surrounds the pipe 5*a*. A sleeve 10, on the other hand, surrounds the nozzle 1. Nozzle cooling and purging air or inert gas 9 is introduced into the gas cooling chamber 2 from the tip of the nozzle 1 through the space which is defined between the sleeve 10 and the nozzle 1.

Also, in recent years, the ash from a furnace is melted to thereby reduce the volume of the ash and render it harmless. FIG. 9 shows one example of a prior art furnace in which such a melting of the ash is carried out by plasma.

In FIG. 9 reference numeral 114 designates a furnace wall; numeral 115 designates a slag outlet; numeral 116 designates an exhaust gas duct; numeral 117 designates an electrode; numeral 118 designates an electrode support device; numeral 119 designates a power supply; numeral 120 designates molten slag; numeral 121 designates inert gas; numeral 122 designates an ash feeding conveyor; numeral 123 designates an ash hopper; numeral 124 designates a batch type feeder; numeral 125 designates an ash inlet port; numeral 126 designates a dust collector; numeral 127 designates an induced draft fan; numeral 128 designates a water bath for quickly cooling molten slag; numeral 129 designates a slag hopper; and numeral 130 designates a cooling water circulation pump.

In this furnace, substances having low-boiling temperatures in the ash may volatilize, and when the vapors of volatilization cool at the exhaust gas duct 116, the vapors condense on the duct 116 or dust discharged from the furnace may adhere to or become deposited on the duct 116. Thus, the duct 116 becomes clogged. Moreover, slag may cool down and likewise clog the slag outlet 115. These problems create a bottleneck in a furnace of this kind because they form an obstruction to the continuous operation thereof.

In the water injection nozzle of the prior art, as shown in FIG. 8, the water 4 is injected from the tip of the water injection nozzle 1 at a high speed and thus generates a wake (or vortexes) 24 as indicated by arrow b. Dust 22, which is being carried by hot exhaust gas 16 flowing in the direction of arrow a, is caught in the wake 24, thus producing flower 23 around the nozzle or otherwise causing the dust to adhere to the furnace wall.

As the amount of flower 23 increases, it begins to directly impede the injected water. Finally, a stable injection of water is prevented, and the flower 23 is wetted together with the refractory wall 3 by such an unstable water injection, whereby the refractory wall 3 is deteriorated. Moreover, when the exhaust gas 16 contains hydrogen chloride (HCl) and/or sulfur oxide (SOx) and is absorbed by the wet flower 23, acidic water formed by the HCl and/or SOx seeps into the refractory wall 3 and has the potential to corrode a shell 12 forming the outer casing of the furnace.

SUMMARY OF THE INVENTION

An object of the present invention is to solve the above-identified problems in the prior art.

To achieve this and other objects of the present invention, there are provided:

1. A method of preventing dust from adhering to an interior surface of a wall of a combustion apparatus, for example, a furnace or incinerator, wherein a portion of the wall to which the dust might otherwise adhere (such as a furnace wall or side wall of an incinerator) is made of a refractory porous member and gas is injected through the porous member. Accordingly, the surface of the wall is not only purged of dust, but the dust is inhibited from adhering to the surface in the first place.

2. A method of preventing dust from adhering to the wall of a fluidized bed incinerator, wherein water is injected as an atomized spray at a location above the fluidized bed so as to cool the exhaust gas, and a gas is injected through a refractory porous member extending around such location. Accordingly, the injected gas prevents dust from accumulating at the location where the water is injected and at which location the interior surface has become wet. Moreover, the gas attenuates the wake formed by the spray thereby preventing an entrainment of dust and the scattering of the same onto the incincerator wall.

3. An incinerator wherein a refractory porous member is provided around a liquid injection nozzle extending through the incinerator wall, and a gas is fed into the incinerator through the refractory porous member. Preferably the refractory porous member is a foamed ceramic and the injected gas is air.

In this incinerator, the dust around the liquid injection nozzle is purged, and the wake of injected liquid is attenuated to prevent an entrainment of the dust, thereby in turn preventing the adhesion of dust, i.e. flower, around the nozzle.

5. A melting furnace wherein a slag separating chamber and an exhaust gas duct open to an upper portion of the slag separating chamber include porous refractory members forming the ceiling of the slag separating chamber and the entrance of the exhaust gas duct, casing plates form wind boxes with the porous refractory members, and cooling gas is fed into the wind boxes.

In the furnace of the present invention, because the refractory porous members form a portion of the exhaust gas duct and slag separating chamber and gas (such as air) is forced through the refractory porous members into the slag separating chamber and the exhaust gas duct, the gas not only abruptly cools and solidifies the gaseous substances of low-boiling temperatures in the gas cooling chamber whereby such substances transform to liquid phase for a short period of time, but also purges the dust of the exhaust gas. Thus, outlets or the like of the furnace will not become blocked with the substances of low-boiling temperatures in the exhaust gas and with the scattered dust. Moreover, the exhaust gas and slag are discharged from a common exhaust port, so that the slag can be prevented from cooling on the exit channel. Thus, the slag will not solidify and cause a clogging of the outlet.

BRIEF DESCRIPTION OF THE DRAWINGS

Other objects and features of the present invention will become apparent from the following description made with reference to the accompanying drawings, in which.

DETAILED DESCRIPTION OF THE PREFERRED EMBODIMENTS

Figure 2:
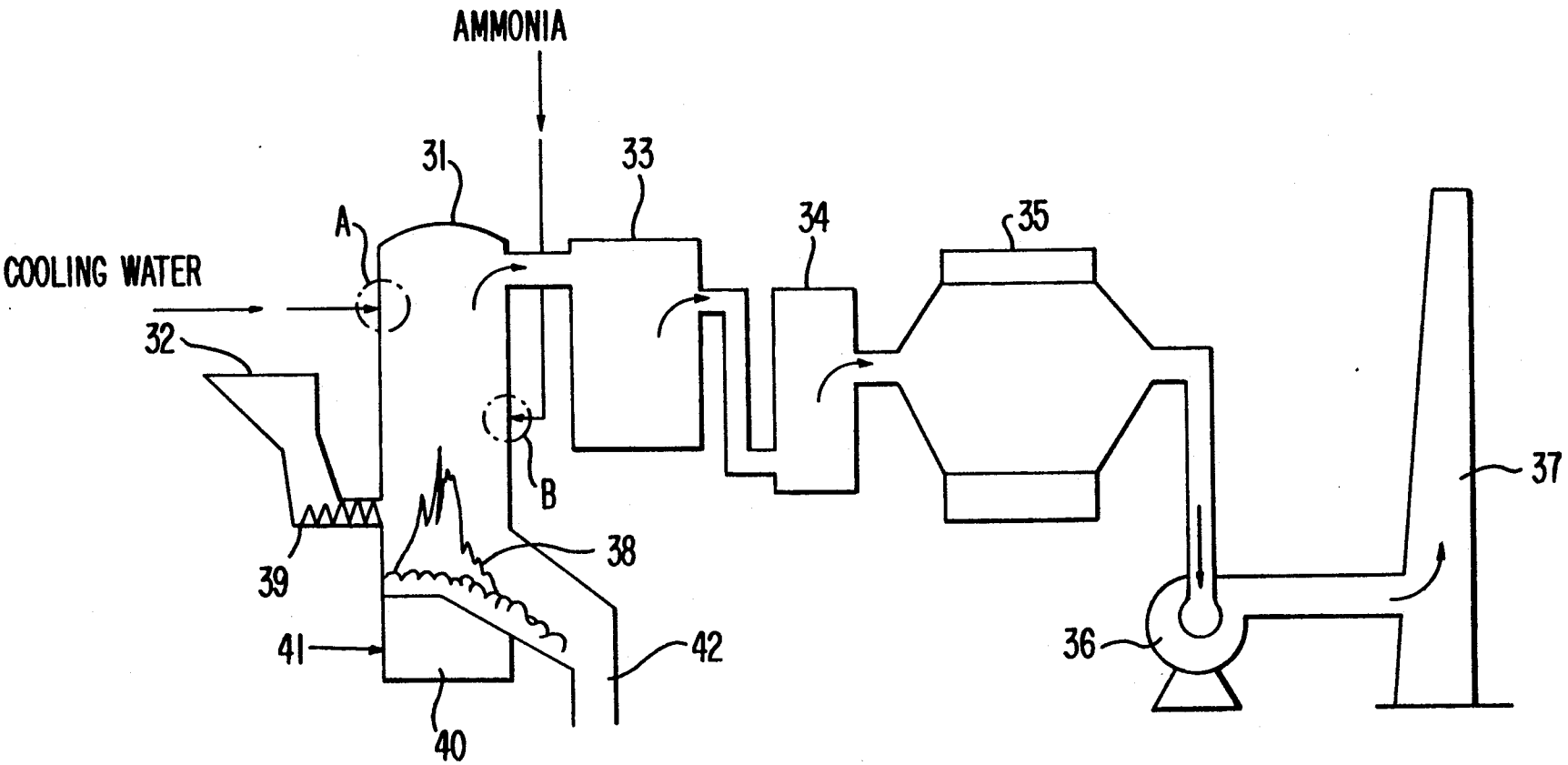
FIG. 2 is a schematic diagram of a plant including a fluidized bed incinerator in which injection nozzles according to the present invention are incorporated.

First, reference will be made to a fluidized bed incinerator shown in FIG. 2 which makes use of the injection nozzles of the present invention.

The fluidized bed incinerator is fed with material to be burned such as sludge by way of a hopper 32 and a feeding device 39. The sludge or the like is burned in the sand layer of the fluidized bed incinerator 31 with combustion air 41 which is introduced from a wind box 40 located at the lower portion of the fluidized bed incinerator 31. Cooling water and a mixture of ammonia and water for treating the combustion gas are introduced through the side wall of the fluidized bed incinerator 31 at locations indicated by A and B, respectively, into the gas cooling chamber which is defined at the top zone of the fluidized bed incinerator 31. The exhaust gas produced as a result of the combustion flows in the directions of the arrows in FIG. 2 through a heat exchanger 33, such as a boiler, and through an exhaust gas treating device 34 and an electric dust collector 35 in which the exhaust gas is cleaned. The cleaned exhaust gas is discharged from a stack 37 by an induced draft fan 36 On the other hand, the unburned components are discharged from a discharge port 42 which is located at the bottom of the fluidized bed incincerator 31.

Injection nozzles of the present invention are disposed at the above-mentioned locations A and B.

Figure 1:
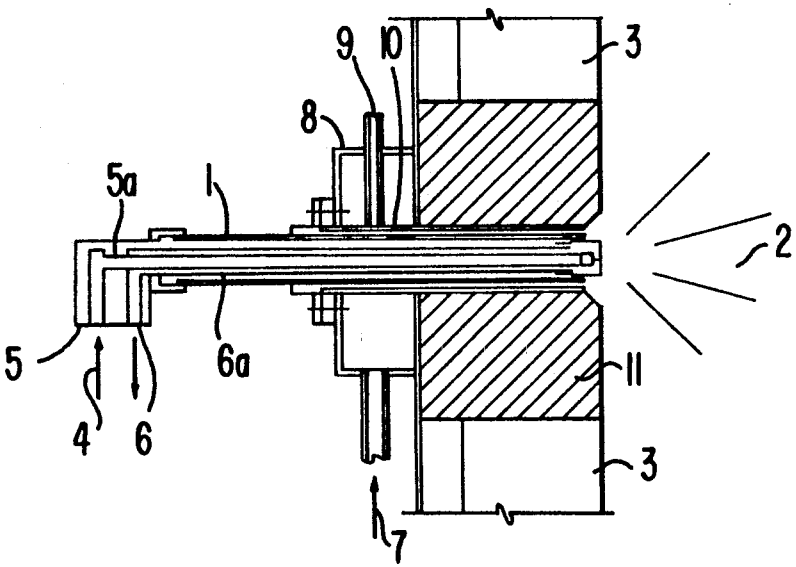
FIG. 1 is a longitudinal sectional view of an embodiment of a water injection nozzle according to the present invention.

The water injection nozzle 1 (FIG. 1) extends through a porous refractory member 11 of ceramics provided to form part of the side wall of the fluidized bed incinerator 31 defining therein the gas cooling chamber 2 of the fluidized bed incinerator. The porous refractory member 11 is surrounded by a refractory casting or by refractory brick 3

Figure 8:
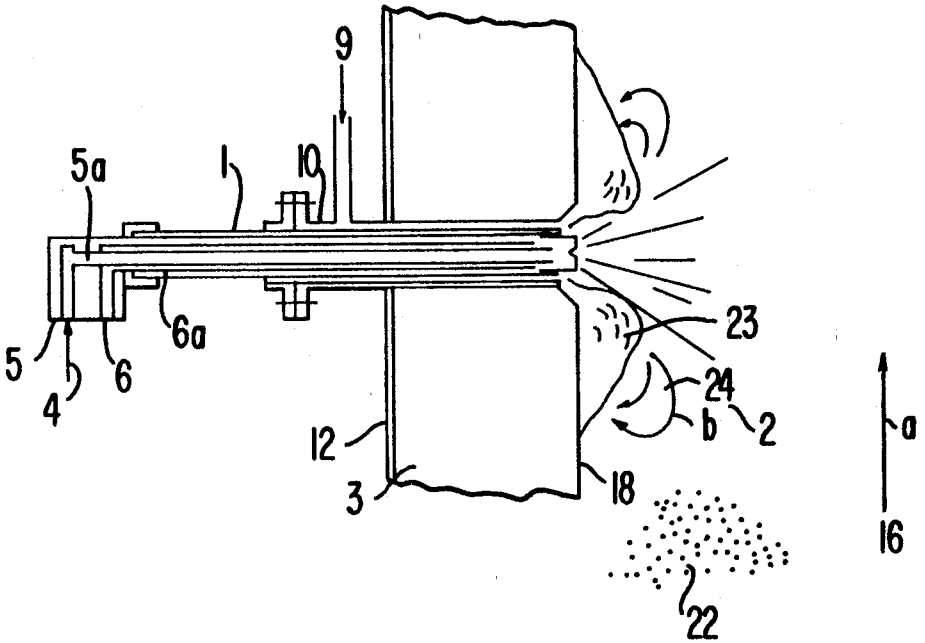
FIG. 8 (PRIOR ART)
FIG. 8 is a longitudinal sectional view of a prior art gas cooling water injection nozzle.

Cooling air 9 is fed, as in the prior art water injection nozzle shown in FIG. 8, into the gas cooling chamber 2 from the tip of the water injection nozzle 1 as passing through the space defined between a sleeve 10 and the nozzle 1.

A wind box 8 is disposed to the side of the refractory member 11 at the exterior of the gas cooling chamber 2. The wind box 8 has a box-like structure surrounding the water injection nozzle 1 and is open at a side thereof disposed against the porous refractory member 11.

Moreover, the wind box 8 is fed with air 7 to prevent the formation of flower adjacent the tip of the nozzle. Specifically, the air 7 is fed from the wind box 8 into the hot gas in the gas cooling chamber 2 via the porous refractory member 11 by passing from one side thereof to the other through the pores in the refractory member so as to cool the hot gas.

Accordingly, the production of flower on that portion of the side wall adjacent the tip of the water injection nozzle is prevented.

Further, the air 7 fed into the hot gas purges the tip of the water injection nozzle 1 of dust scattered thereabout, and attenuates the wake of the water injected from the tip of the same nozzle 1 into the cooling chamber, thereby preventing an entrainment of the dust in the injected water.

Figure 3B:
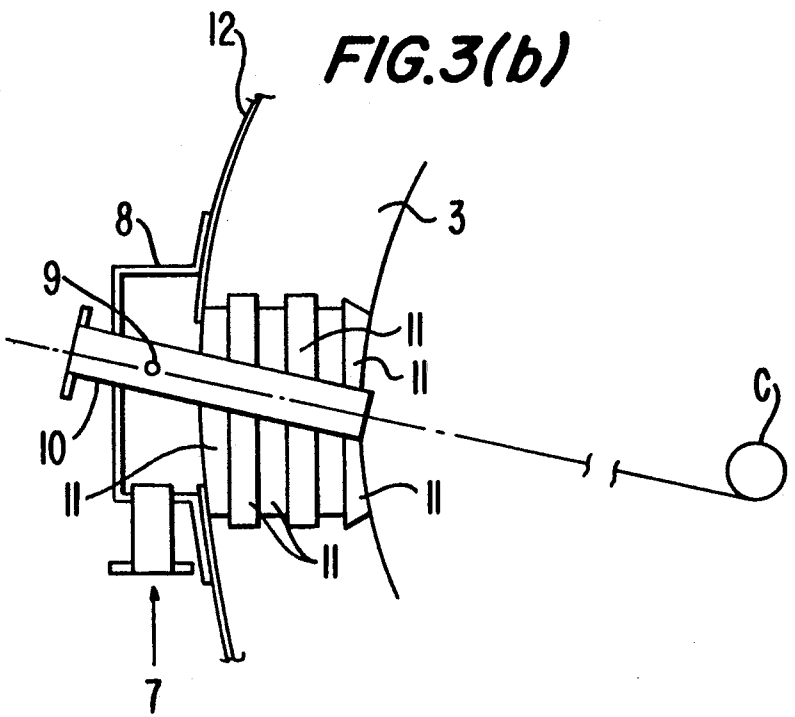
FIGS. 3(*a*) and 3(*b*) are detailed side elevation and transverse sectional views, respectively, of a water injection nozzle according to the present invention.
Figure 3A:
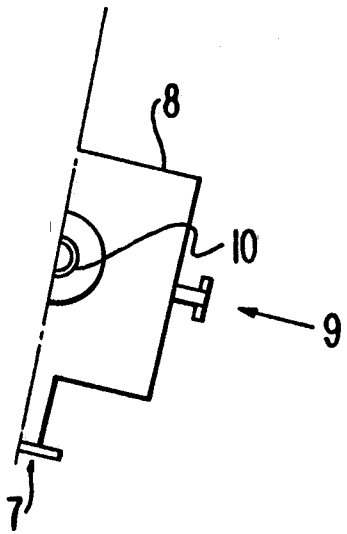
Figure 4:
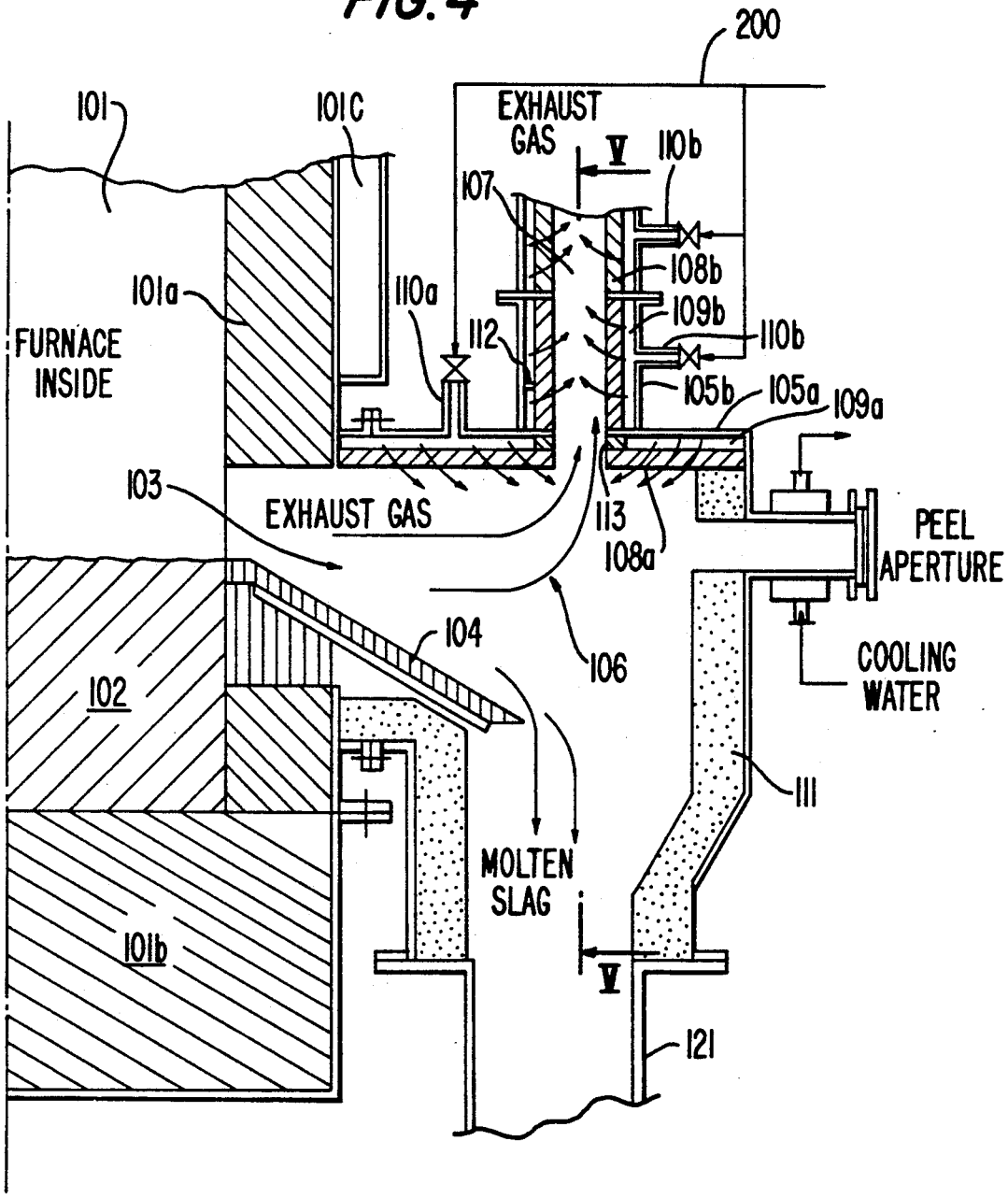
FIG. 4 is a longitudinal sectional view of discharge structure of an embodiment of an ash melting furnace according to the present invention.
Figure 5:
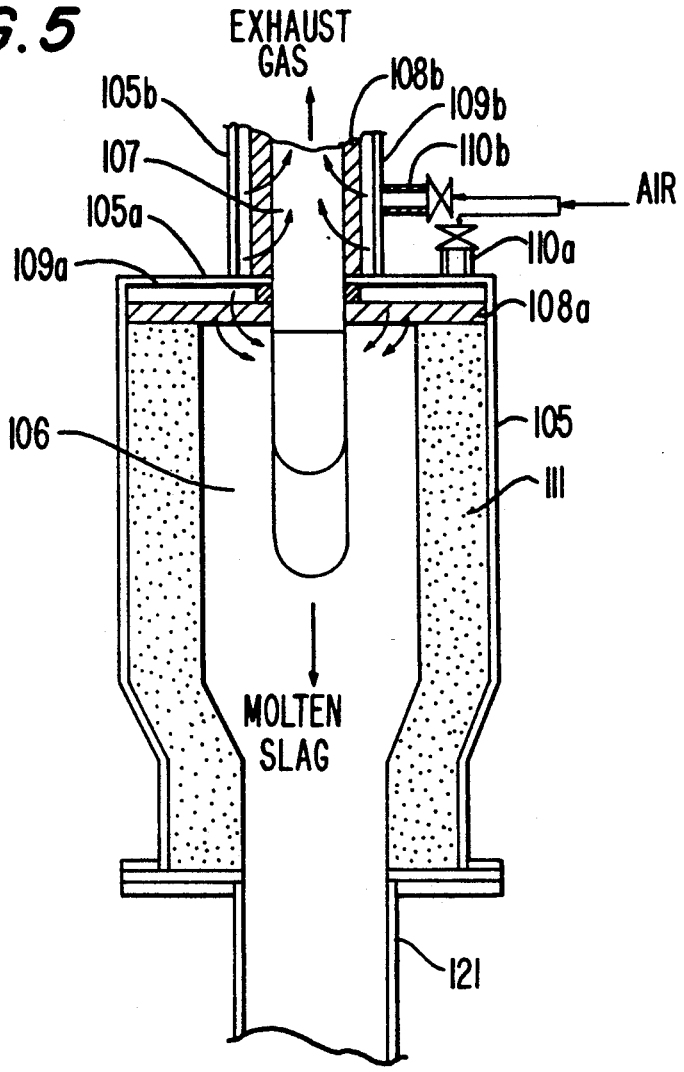
FIG. 5 is a sectional view taken along line V—V of FIG. 4.
Figure 7:
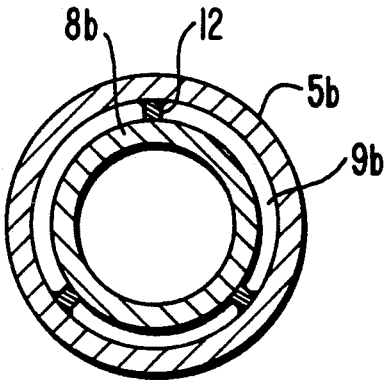
FIG. 7 is a horizontal cross-sectional view taken along line VII—VII of FIG. 6.
Figure 6:
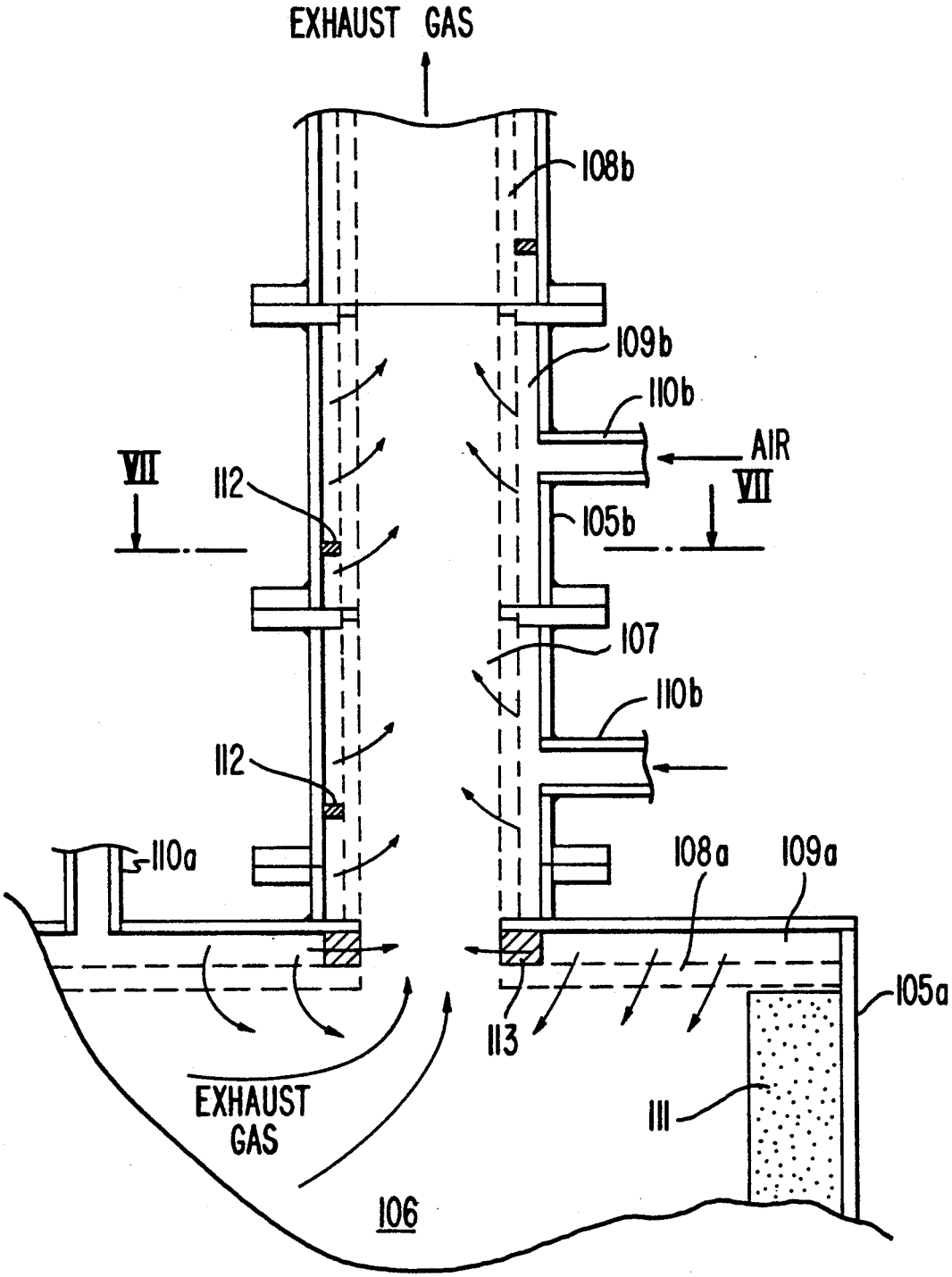
FIG. 6 is an enlarged detailed diagram of a portion of the structure shown in FIG. 4 including an upper portion of a slag separating chamber and an exhaust gas duct.
Figure 9:
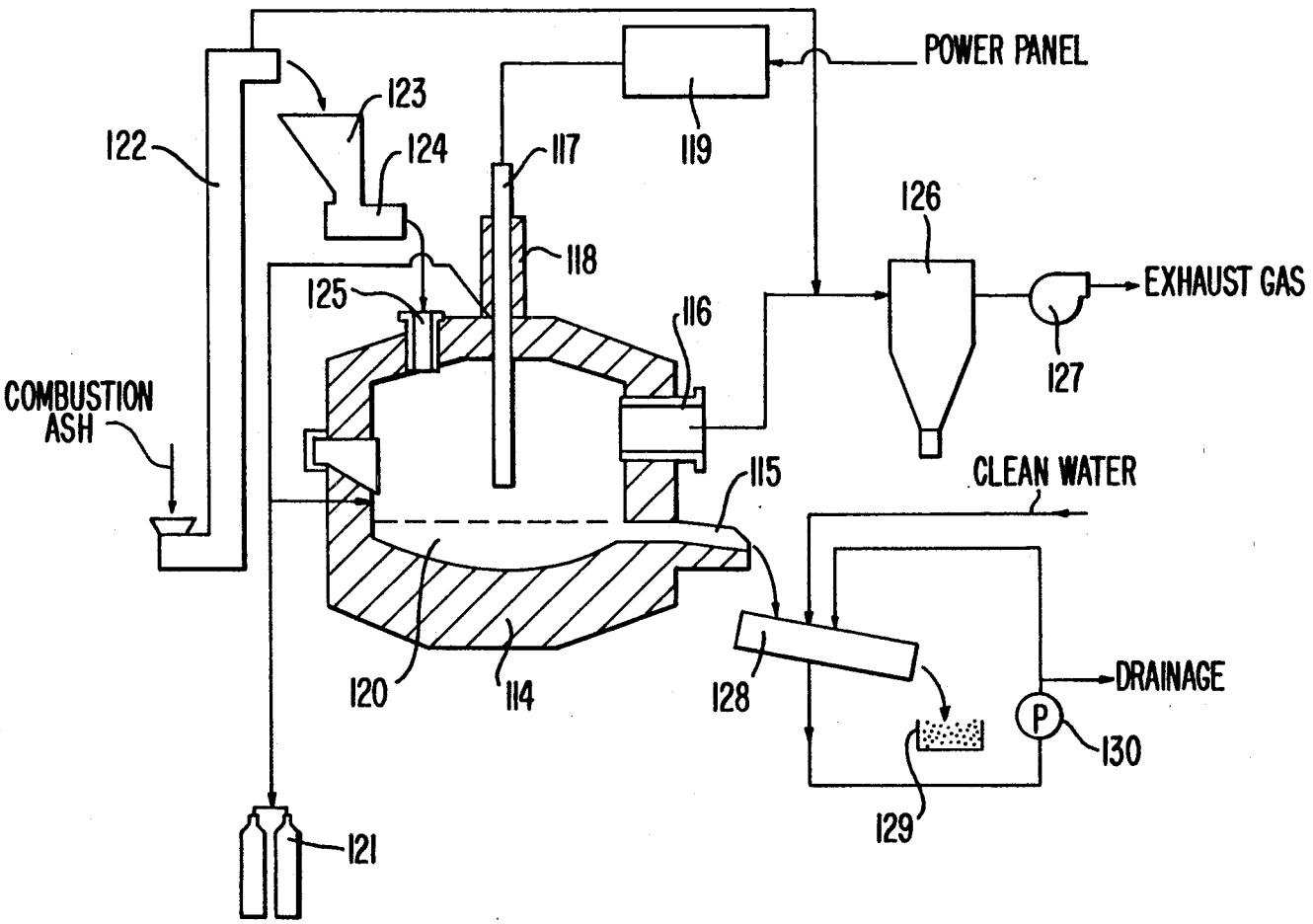
FIG. 9 (PRIOR ART)
FIG. 9 is a schematic diagram of a prior art ash melting furnace.

The detailed structure of the nozzle is shown in FIGS. 3(*a*) and 3(*b*). The opening at the side of the wind box 8 facing the porous refractory member 11 is a square, having depth of 350 mm. Each of several blocks of porous refractory material (ceramic foam) has a square cross section, sides of 450 to 500 mm, and a thickness of about 60 mm. The refractory members are laminated as shown in FIG. 3(*b*). The laminate is worked to conform the outer side surface thereof to the inner curved surface of a shell 12 disposed outside of the refractory body 3 so that the laminate becomes substantially entirely embedded in the refractory body 3.

The sleeve 10 through which the cooling air is injected is so inclined with respect to the center of the fluidized bed incinerator 31 as to define an injection axis tangential to circle C coaxial with the fluidized bed incinerator 31. This imaginary circle has an area of about 4% of the sectional area of the exhaust gas to be cooled in the incinerator. The exhaust gas in the fluidized bed incinerator is swirled by the injected water jet to facilitate the mixing of the injected water jet (atomized spray) and the rising exhaust gas.

The porous refractory member 11 is made of ceramic such as cordierite, cordierite plus alumina, SiC or silicon nitride. From the practical standpoint of durability, the desired properties of the material constituting the porous refractory member 11, such as those of the foamed ceramics, are: a bulk specific gravity of 0.35 to 0.45; a porosity of 80 to 90%; a compression strength of 20 to 25 $Kg/cm^2$; a pressure loss at ceramics of 20 to 60 mm Aq.; and 6 to 13 pores over a length of 25 mm. Further, an inert gas can be used instead of the air.

Under the following operation conditions, it was confirmed that an apparatus incorporating the injection nozzles of the present invention could run stably without producing any flower at the tip of the nozzle:

| | |
|---|---|
| Burning Rate of Sludge | 50 Tons/day |
| Air Flow | 6,800 $Nm^3$/hour |
| Exhaust Gas Temperature | 850–900° C. |
| Exit Gas Temperature | 350° C. |
| Water Injection Rate | about 3 Tons/hour |
| Porous Refractory Member | Ceramic Foam of $Al_2O_3$ |
| Exhaust Gas Flow Speed | about 1.5 m/sec. |
| Air Speed from Foamed Ceramics | about 2 m/sec. |

Next, an ash melting furnace according to the present invention will be described with reference to FIGS. 4 to 7.

In these Figures, reference numeral 101 designates a furnace body having a refractory wall which is cooled by water. This wall is formed by a refractory wall member 101*a*, refractory furnace bottom member 101*b*, and a cooling water jacket 101*c*. The slag 102 accumulated at the bottom of the furnace overflows and is discharged to the outside of the furnace through an outlet 103 and an inclined channel 104. The slag outlet of the furnace defines a slag separating chamber 106 and a gas duct 107 through which exhaust gas is discharged. Moreover, the slag separating chamber 106 is formed by a refractory structure 111 of the slag outlet, and by a ceiling in the form of a plate-like porous refractory member 108*a* and a casing 105*a* spaced thereabove so as to define a wind box 109*a*. The inlet of the exhaust gas duct 107 is formed by a casing 105*b* spaced radially outwardly of a plate-like porous refractory member 108*b* so as to define a wind box therebetween. Moreover, cooling and purging air 200 is fed to these wind boxes 109*a* and 109*b* through gas nozzles 110*a* and 110*b*.

Also, in the figures, reference numeral 112 designates a fixture for fixing the porous member 108*b* in place, numeral 113 designates an annular porous refractory member, and numeral 121 a molten slag outlet pipe open to the lower portion of the slag separating chamber 106.

The cooling/purging air 200 is fed from the aforementioned gas nozzles 110*a* and 110*b* into the wind boxes 109*a* and 109*b*, and is injected through the porous refractory members 108*a* and 108*b* into the slag separating chamber 106 and the exhaust gas duct 107 to purge the same of both substances having low-boiling temperatures and of dust, thereby preventing the furnace outlet and the gas duct from being clogged. Experiments have been conducted in which gas has been fed through the refractory porous members 108*a* and 108*b* at a speed within a range of 0.05 to 2.0 times as high as that of the hot gas to be cooled. The experiments have confirmed that continuous operation under such parameters could be safe without scattered dust or gaseous substances of low-boiling temperatures adhering/sticking to and accumulating on the inner walls of the furnace which form the slag separating chamber and the exhaust gas duct. The range of suitable speeds under which to inject the gas is more or less different depending upon the kinds and densities of the object gas, the substances of low-boiling temperatures and the dust. In some gaseous substances of low-boiling temperatures, the aforementioned problems could be prevented even with a small amount of injected gas. Incidentally, the porous refractory members 108*a* and 108*b* are made of ceramic such as cordierite, cordierite containing alumina, alumina, silicon carbine, silicon nitride or another metal (e.g., SUS).

According to the present invention, moreover, a drop in the temperature of the slag flowing along the channel 104 can be prevented by simultaneously discharging the exhaust gas and the slag. This will stabilize the slag discharge.

Moreover, since the air is fed for cooling/purging purposes, the air can provide other effects such as assisting the combustion of unburned gas (e.g., CO).

It is to be understood that various changes and modifications of the present invention will be apparent to those of ordinary skill in the art from the description above. For example, the present invention is applicable to furnaces other than the type described above. Moreover, inert gas instead of air can be forced in the wind boxes through the porous refractory members. Therefore, all such changes and modifications are to be understood as being within the true spirit and scope of the invention as defined in the appended claims.

What is claimed is:

1. Nozzle structure for use in cooling exhaust gas in a combustion apparatus, said nozzle structure comprising: a block of porous refractory material having opposite side surfaces, said block capable of forming a portion of a wall of the combustion apparatus; a nozzle extending through said block of porous refractory material and having a leading end the tip of which terminates adjacent one side surface of said block of porous refractory material, the nozzle having at least one passageway extending therethrough to the leading end of the nozzle so as to be open at said one side surface of the block of porous refractory material; and means for directing forced air through pores of said porous refractory material from the other side surface of said block of porous refractory material to said one side surface thereof so as to prevent dust from accumulating at the tip end of the nozzle.

2. Nozzle structure as claimed in claim 1, wherein said means for directing forced air is a wind box having a box-like structure covering at least a portion of the other side surface of said refractory member, the box-like structure being open at a side thereof disposed against said other side surface of said refractory member such that the interior of the wind box is in open communication with pores of said porous refractory material.

3. Nozzle structure as claimed in claim 1, wherein said porous refractory material comprises ceramics.

4. Nozzle structure as claimed in claim 1, wherein said block of porous refractory material is a laminate of individual blocks of porous refractory material.

5. Nozzle structure as claimed in claim 4, wherein said porous refractory material comprises ceramics.

6. An incinerator comprising: an incinerator wall defining a gas cooling chamber therein, the incinerator wall including a porous refractory member having one side exposed to the gas cooling chamber and another side at the exterior of said wall, a nozzle extending through said porous refractory member and having a leading end terminating adjacent said one side of said porous refractory member, the nozzle having at least one passageway extending therethrough to the leading end of the nozzle so as to be open to said gas cooling chamber; and means for directing forced air through said porous refractory member from said another side of said member to said one side thereof.

7. An incinerator as claimed in claim 6, wherein said means for directing forced air is a wind box having a box-like structure covering at least a portion of said another side of said refractory member, the box-like structure being open at a side thereof disposed against said another side of said refractory member such that the interior of the wind box is in open communication with pores of said porous refractory member.

8. An incinerator as claimed in claim 6, wherein said porous refractory member comprises ceramics.

9. An incinerator as claimed in claim 6, wherein said porous refractory member is a laminate of blocks of porous refractory material.

10. An incinerator as claimed in claim 9, wherein said porous refractory material comprises ceramics.

11. An incinerator as claimed in claim 9, and further comprising a shell extending in a direction around said incinerator wall, and wherein said another side of said porous refractory member has a shape complementary to that of said shell.

12. An incinerator as claimed in claim 11, wherein said means for directing forced air is a wind box having a box-like structure covering at least a portion of said another side of said refractory member, the box-like structure being open at a side thereof disposed against said another side of said refractory member such that the interior of the wind box is in open communication with pores of said porous refractory member.

13. A furnace comprising: a furnace body; a slag outlet open to said furnace body at the bottom thereof, said slag outlet including a slag separating chamber, an exhaust gas duct open to said slag separating chamber at an upper portion of said chamber, and a slag outlet open to said slag separating chamber at a lower portion of said chamber; said slag separating chamber having a ceiling comprising a refractory porous member and a plate-like member disposed above said refractory porous member so as to define a wind box therebetween; said gas duct comprising a porous refractory member and a plate-like member spaced radially outwardly therefrom so as to define a wind box therebetween; and means for introducing cooling gas into said wind boxes such that the cooling gas will be forced through the pores of said porous refractory members.

14. A furnace as claimed in claim 13, wherein said porous refractory members each comprise ceramics.

15. A method of preventing dust from adhering to an interior surface of a wall in a combustion apparatus, said method comprising:

forming a portion of a wall of the combustion apparatus as a porous refractory member at a location where dust would otherwise tend to adhere to the inside surface thereof; and injecting gas through pores of said porous refractory member.

16. A method of preventing dust from adhering to an interior surface of a wall of a gas cooling chamber of a fluidized bed incinerator, said method comprising:

feeding an atomized spray of water into said gas cooling chamber at a location above the fluidized bed of the incinerator;

forming a portion of the wall of said gas cooling chamber, at the periphery of said location, as a porous refractory member having one side exposed to said gas cooling chamber and another side facing outwardly with respect to said chamber; and forcing gas through pores of said porous refractory member from said another side of said porous refractory member to said one side thereof.

* * * * *